US005775577A

United States Patent [19]

Titus

[11] Patent Number: 5,775,577

[45] Date of Patent: Jul. 7, 1998

[54] DISPOSABLE INSULATED CONTAINER WITH MICROFLUTE STRUCTURE

[75] Inventor: Jack H. Titus, Middletown, Calif.

[73] Assignee: Baldocci, Modena, Scherrer, Stanghellini Family Trust, and Titus, Calif.

[21] Appl. No.: 731,317

[22] Filed: Oct. 15, 1996

[51] Int. Cl.[6] ..... B65D 3/22

[52] U.S. Cl. ..... 229/403; 229/400; 229/939; 229/940; 493/111; 493/296; 493/903; 493/908

[58] Field of Search ..... 229/4.5, 400, 403, 229/939, 940; 220/443, 737–739; 493/84, 111–114, 296, 297, 903, 906, 908

[56] References Cited

U.S. PATENT DOCUMENTS

| | | | |
|---|---|---|---|
| 1,771,765 | 7/1930 | Benson | 229/4.5 |
| 2,266,828 | 12/1941 | Sykes . | |
| 2,661,889 | 12/1953 | Phinney | 220/441 |
| 3,082,900 | 3/1963 | Goodman | 229/403 |
| 3,456,860 | 7/1969 | Jannick . | |
| 3,908,523 | 9/1975 | Shikaya . | |
| 4,080,880 | 3/1978 | Shikaya | 493/296 |
| 4,548,349 | 10/1985 | Tunburg . | |
| 4,993,580 | 2/1991 | Smith | 229/939 |
| 5,092,485 | 3/1992 | Lee | 229/403 |
| 5,102,036 | 4/1992 | Orr et al. | 220/903 |
| 5,205,473 | 4/1993 | Coffin, Sr. . | |
| 5,226,585 | 7/1993 | Varano . | |
| 5,363,982 | 11/1994 | Sadlier | 493/111 |
| 5,385,260 | 1/1995 | Gatcomb | 493/114 |
| 5,460,323 | 10/1995 | Titus . | |
| 5,547,124 | 8/1996 | Mueller | 493/111 |

FOREIGN PATENT DOCUMENTS

| | | | |
|---|---|---|---|
| 40 5004670 | 1/1993 | Japan | 229/403 |

*Primary Examiner*—Gary E. Elkins
*Attorney, Agent, or Firm*—Feix & Feix

[57] ABSTRACT

A disposable insulated container comprises an inner container structure and an outer insulating wrap. The outer insulating wrap comprises a microflute laminated structure having a first corrugated laminate of microflute corrugations which extends substantially circumferentially around the side wall of the inner container and a second, outer sheet laminate of the thin flexible paper which presents a substantially smooth outer surface for engagement by the hand of a user of the container.

16 Claims, 2 Drawing Sheets

DISPOSABLE INSULATED CONTAINER WITH MICROFLUTE STRUCTURE

BACKGROUND OF THE INVENTION

This invention relates generally to a disposable insulated container.

This invention relates particularly to a disposable insulated container having an outer insulating wrap embodying a microflute laminated structure.

The disposable insulated container of the present invention is particularly adapted to contain hot liquids, such as, for example, hot coffee dispensed at temperatures very close to the boiling point of water.

U.S. Pat. No. 5,226,585 issued Jul. 13, 1993, discloses a disposable insulated container made of materials which are biodegradable. U.S. Pat. No. 5,460,323 issued Jan. 10, 1995, also discloses a disposable insulated container made of materials which are biodegradable. The U.S. Patent No. 5,226,585 and the U.S. Pat. No. 5,460,323 are incorporated by reference in this application.

The container of the present invention is similar to the containers of U.S. Pat. Nos. 5,226,585 and 5,460,323 in that the containers of both patents and the container of the present invention utilize a construction in which the side wall embodies structure for providing insulation for the contents contained within the container; but the configuration and function of the outer insulating wrap of the present invention (a wrap with a microflute structure) are, however, quite different from the structures disclosed in U.S. Pat. Nos. 5,226,585 and 5,460,323.

SUMMARY OF THE INVENTION

The disposable, insulated container of the present invention comprises an inner container structure having an upper end portion providing an open top, a lower end portion providing a closed bottom, and a generally conically extending side wall portion providing a closed side wall between the open top and the closed bottom.

In the present invention an outer insulating wrap extends both around and up and down the outer side of the side wall for enabling the container to be held comfortably in the hand of a user when the container is filled with a liquid having temperatures up to or near the boiling point of water.

The outer insulating wrap is adhered to the side wall of the inner container structure so that the outer insulating wrap cannot slip off of the inner container structure.

The outer insulating wrap comprises a microflute laminated structure.

The microflute laminated structure has a first, corrugated laminate of microflute corrugations which are aligned so that the parallel extending ridges and depressions of the microflute corrugations are disposed substantially circumferentially around the side wall of the inner container structure.

The outer insulating wrap also comprises a second, outer sheet laminate of thin flexible paper extending on the outer side of the outer insulating wrap. This sheet laminate of thin flexible paper presents a substantially smooth outer surface for engagement by the hand of a user of the container.

The size of the microflute corrugations, the generally circumferentially extending orientation of the microflute corrugations, and the thin thickness of the outer paper sheet laminate enable the outer insulating wrap to be wrapped and maintained in continuous, substantially uniform engagement with the side wall portion without breaking or collapsing of the corrugations.

It is an important feature of the present invention that the microflute corrugations do not provide total isolation or blocking of all heat transfer from the contained liquid to the hand of the user.

Instead, the wrap permits some heat to be transferred so as to provide a tactile sense of temperature in the hands of the user. This tactile feel signals the sensory system of the user that there is a hot liquid in the cup. This in turn minimizes the possibility of unexpected burning of the lips, or other parts of the personal user, which could result from an unexpectedly high temperature of the contents of the cup when the contents of the cup first engages the lips of the user.

This ability to provide tactile sensing of the fact that the liquid in the cup is hot minimizes the risk of injury to the person drinking coffee or other hot liquid from the container.

It is an important feature of the present invention that the wrap, prior to assembly on the inner container, is formed with an inwardly curved configuration which predisposes the wrap to wrap about the side wall of the inner container structure.

This predisposition to wrap has an unexpected benefit of enhancing the ability of the wrap to be wrapped and maintained in continuous, substantially uniform engagement with the side wall without breaking or collapsing of the corrugations which provide a significant part of the insulating property of the wrap.

A container which embodies the features described above and which is effective to function as described above comprises specific objects of the present invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

Figure 3:
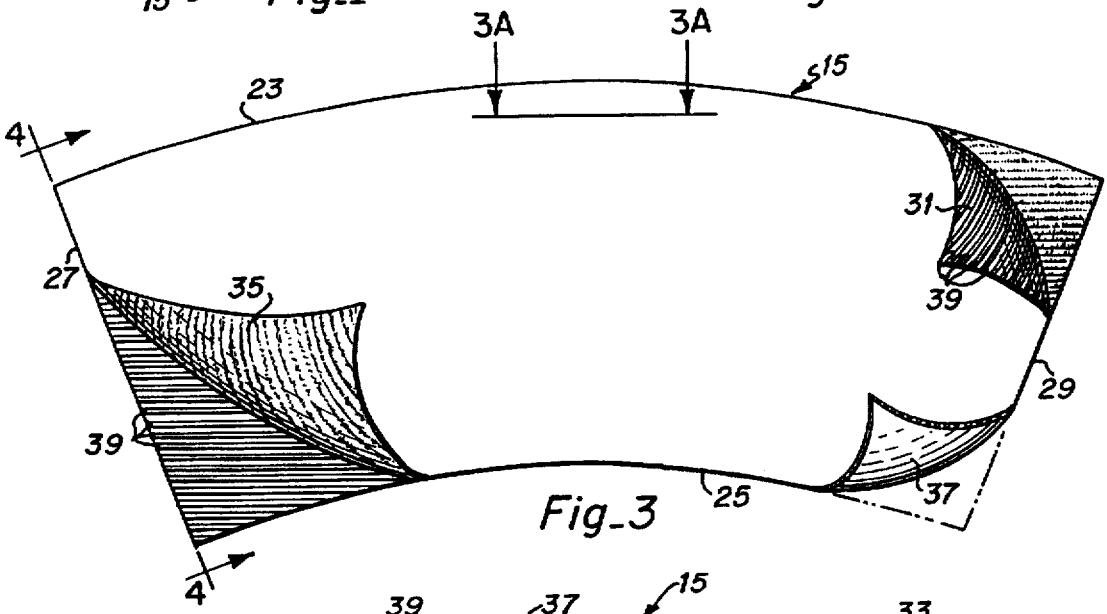

FIG. 3 is a top plan view of an outer insulating wrap constructed of a microflute laminated structure in accordance with one embodiment of the present invention. FIG. 3 shows the outer insulating wrap disposed flat and shows two corner portions of the wrap having certain laminates peeled back and shows one corner portion turned up to illustrate features of the microflute corrugated laminate structure.

Figure 3A:
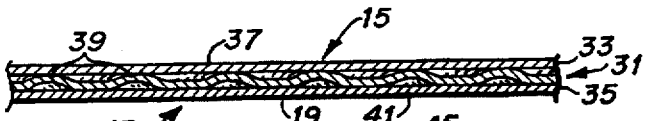

FIG. 3A is an enlarged, fragmentary view in cross section and taken generally along the line and in the direction indicated by the arrows 3A—3A in FIG. 3.

Figure 4:
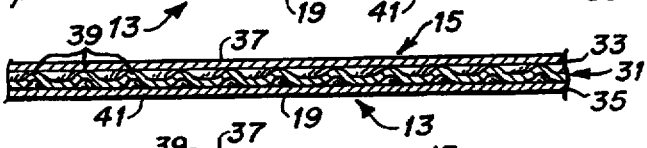

FIG. 4 is an enlarged, fragmentary, end view of the wrap of FIG. 3 and is taken along the line and in the direction indicated by the arrows 4—4 in FIG. 3.

Figure 1:
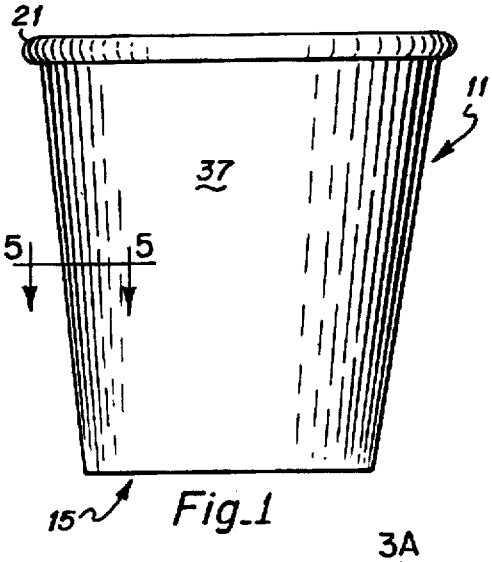
FIG. 1 is a side elevation view of a disposable insulated container constructed in accordance with one embodiment of the present invention. The container shown in FIG. 1 incorporates an outer insulating wrap which is shown separately in FIG. 3.
Figure 5:
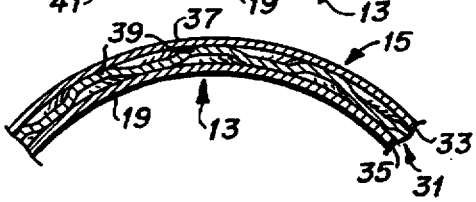

FIG. 5 is an enlarged, fragmentary view in cross section and is taken along the line and in the direction indicated by the arrows 5—5 in FIG. 1.

Figure 6:
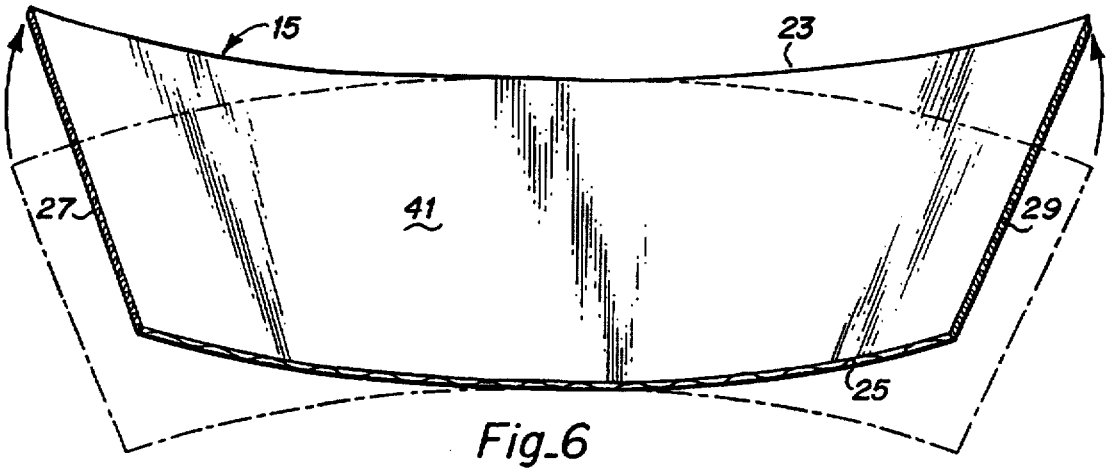

FIG. 6 is a perspective view of a wrap constructed in accordance with one embodiment of the present invention and having a three laminate microflute structure. FIG. 6 illustrates how the wrap is formed to a curved configuration so as to be predisposed to wrap around a side wall portion of an inner container structure of the cup shown in FIG. 1. In FIG. 6 the dashed outline indicates the pattern of the generally trapezoidal, shape to be cut from a sheet of microflute corrugated material. The direction arrows indicate how the wrap is formed (prior to assembly on the inner container) with an upwardly bowed configuration so as to be predisposed to wrap on the side wall of the inner container structure of the cup.

Figure 7:
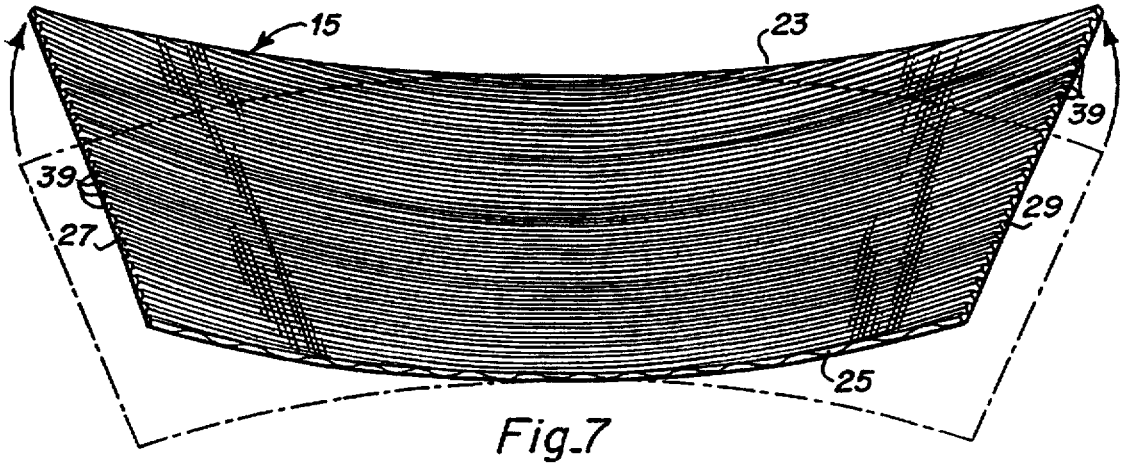

FIG. 7 is a view like FIG. 6 but showing a second embodiment of the wrap structure in which the wrap comprises a two laminate structure, rather than the three laminate structure shown in FIG. 6.

DETAILED DESCRIPTION OF THE PREFERRED EMBODIMENTS

Figure 2:
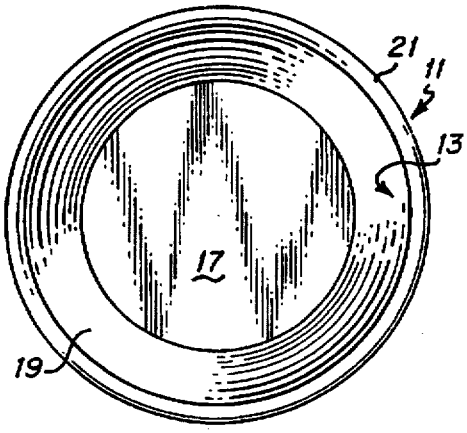
FIG. 2 is a top plan view of the container shown in FIG. 1.

A disposable, insulated container constructed in accordance with one embodiment of the present invention is indicated generally by the reference numeral 11 in FIGS. 1 and 2.

The container 11 comprises an inner container structure 13 and an outer insulating wrap 15.

The inner container structure 13 has an upper end portion providing an open top, a lower end portion providing a closed bottom 17, and a side wall portion 19. The side wall portion 19 is shaped generally as a truncated cone and has an inner surface (which can be seen in FIG. 2) and an outer surface (which cannot be seen in the drawings, because the outer surface is covered by the outer insulating wrap 15).

The open top of the inner container structure is formed with a rolled rim 21.

In a specific embodiment of the invention the inner container structure 13 is a standard container structure formed from paper. In the preferred embodiments of the present invention the paper is fully recyclable.

When the inner container structure 13 is formed from paper, the standard industry practice coats the inner and outer surfaces of the paper with a very thin layer of polyethylene. The polyethylene coating blocks the liquid within the container structure from migrating through the paper of the inner container structure, at least for the period of time during which the inner container structure 13 is expected to be used to contain the liquid.

As will be described in more detail below, the present invention utilizes the existing polyethylene coating as part of the means for adhering the wrap 15 to the outer surface of the side wall 19.

Paper inner container structures 13 are used by coffee shops to dispense coffee to customers. The coffee is sometimes dispensed at temperatures at or very near the boiling point of water.

Under these conditions, it is necessary either to "double cup" the inner container structure 13 or to provide insulation around the outer surface of the side wall 19 before the hot coffee filled inner container 13 is picked up by the customer.

Without some additional heat shielding, the inner container structure 13 cannot be held comfortably in the hand of a user while the container is filled with coffee, or another liquid, at such high temperatures.

In accordance with the present invention an outer insulating wrap 15 extends both around and up and down the outer side of the side wall portion 14 of the inner container structure 13 to provide the desired insulation.

The outer insulating wrap 15 is adhered to the side wall portion 19 so that the wrap 15 and inner container structure 13 form a unitary, integral container unit 11. The wrap 15 cannot slip off the inner container structure 13.

When the inner container structure 13 is constructed of paper having a thin polyethylene coating on the inner and outer surfaces (as described above for one standard form of the inner container structure 13), the present invention heats the coating during the manufacturing process to cause the polyethylene coating on the outside surface of the side wall 13 to bond to the wrap 15 and to become part of the mechanism for adhering the wrap 15 to the outer side of the side wall 19.

The means for adhering the wrap 15 to the side wall 19 in accordance with the present invention also include an additional adhesive which is applied to certain parts of the wrap, as will now be described.

The wrap 15 has slightly larger circumferences than the corresponding outer circumferences of the side wall 19 so that one end 27 of the wrap 15 overlaps the other end 29 along a longitudinally extending end margin when a cup is assembled.

The adhesive is applied to this overlap so that the opposed surfaces of the wrap 15 are held together by the adhesive.

In addition, the adhesive is also applied to certain spots on the inner surface of the wrap 15. The wrap 15 is adhered to the outer surface of the side wall 19 by means of the adhesive at such spots.

In the preferred embodiments of the present invention, the adhesive utilized is a fully biodegradable adhesive.

A cold vinyl adhesive and/or a hot melt adhesive can be used as the adhesive in the preferred embodiments of the present invention. Both the cold vinyl adhesive and the hot melt adhesive are fully biodegradable.

The outer insulating wrap 15 is a microflute laminated structure. This microflute laminated structure, the orientation of the microflutes, and the forming of the wrap with a predisposition to wrap produce a member of unexpected and beneficial results which will be described in more detail below.

The microflute laminated structure can have either two laminates (as shown in FIG. 7) or three laminates (as shown in FIGS. 3–5 and 6).

In the preferred embodiments of the present invention, each outer insulating wrap. 15 is formed with an inward curvature (as illustrated in both FIGS. 6 and 7).

The outer insulating wrap 15 is fabricated with the inwardly curved configuration so as to be predisposed to wrap about the inner container structure 13 prior to final assembly with the inner container structure 13.

This predisposition to wrap has an unexpected benefit of enhancing the ability of the wrap 15 to be wrapped and maintained in continuous, substantially uniform engagement with the side wall 19 without breaking or collapsing of the corrugations which provide a significant part of the insulating property of the wrap 15.

As best shown in FIG. 3 the wrap 15 is cut from a sheet of stock so as to have a generally trapezoidal configuration.

The wrap 15 has an upper curved edge 23 and a lower curved edge 25 and two end edges 27 and 29.

The height of the wrap between the upper curved edge 23 and the lower curved edge 25 is preferable substantially the same dimension as the length of the outer surface of the side wall 19 so that the wrap 15 extends substantially entirely from the lower most outer edge of the inner container structure 13 up to and just beneath the lower edge of the rolled rim 33.

As described above, the arcuate distances between the end edges 27 and 29 of the wrap 15 are somewhat greater than the related circumferences of the container structure 13 so that the wrap 15 has an overlap area extending longitudinally along the end edges 27 and 29.

The adhesive, described above, is applied to this overlapping area.

The specific wrap 15 shown in FIGS. 3–5 and 6 is a three element laminate wrap structure.

As shown in the fragmentary, enlarged cross section view of FIG. 3A and FIG. 4, the outer insulating wrap 15 is a microflute laminated structure having a microflute corrugated laminate 31 of microflute corrugations 39 (see FIGS. 3, 4 and 7) which are aligned so that the parallel extending ridges and depressions of the microflute corrugations 39 are disposed substantially circumferentially around the side wall 19 of the inner container structure 13.

In the specific embodiment illustrated in FIGS. 3A and 4, the corrugated laminate 31 is disposed between an outer sheet laminate 33 of thin flexible paper and an inner sheet laminate 35 of thin flexible paper.

The outer side surface 37 of the wrap 15 presents a substantially smooth outer surface for engagement by the hand of a user of the container. This surface 37 also presents a surface which can accept Flexographic printing.

In FIG. 3 the lower left hand corner portion of the wrap 15 is shown with the inner sheet laminate 33 of thin flexible paper peeled back from the microflute corrugated laminate 31 to show the microflute corrugations 39 in the laminate 31 underlying the sheet laminate 33.

In FIG. 3 the upper right hand corner portion of the wrap 15 is shown with both the inner sheet laminate 33 and the microflute corrugated laminate 31 peeled back from the outer sheet laminate 33 of thin flexible paper to show again the microflute corrugations 39 in the microflute corrugated laminate 31.

In FIG. 3 the lower right hand corner portion of the wrap 15 is shown curled back to display the outer surface 37 of the outer sheet laminate 33 of thin flexible paper.

As noted above in this description, it is an important feature of the present invention that the wrap 15 is formed with an inwardly curved configuration which predisposes the wrap 15 to wrap about the side wall 19 of the inner container structure 13. This inwardly curved configuration of the wrap 15 is shown in FIGS. 6 and 7.

The forming of the wrap 15 with the inward curved configuration and the predisposition to wrap is obtained by one or more fabrication techniques used in the forming of the wrap 15.

For example, this inward curvature can be achieved as a part of the operation of cutting the wrap 15 from a sheet of stock. The inward curvature can also be produced, or enhanced, by a separate and additional forming operation prior to assembly of the wrap 15 onto its related container structure 13.

The wrap 15 shown in FIG. 6 is a three element laminate wrap structure like that described immediately above with reference to FIGS. 3, 3A, 4 and 5.

In this embodiment the inner sheet laminate 35 of thin flexible paper provides a continuous, smooth inner surface 41 for engagement with and for adhering to the outer surface of the side wall portion 19.

In the embodiment of the wrap 15 shown in FIG. 7, the wrap is a two element laminate wrap structure which comprises the microflute corrugated laminate 31 and the outer sheet laminate 33 of thin flexible paper, but which does not include the inner sheet laminate 35 of the FIG. 6 embodiment.

In the embodiment of the wrap 15 shown in FIG. 7, the microflute corrugations 39 of the microflute corrugated laminate 31 are adhered to the outer surface of the side wall 19 both by the thin layer of polyethylene (pre-existing on the outer surface of the side wall portion 19 as described above) and by the spots of additional adhesive applied to the certain areas of the wrap 15 and the side wall portion 19, as described above.

The size of the microflute corrugations 39, the orientation of the corrugations, and the flexibility and thickness of the paper stock used to form the microflute corrugations are critical features in the present invention.

If the corrugations are too large or if the paper stock is too inflexible, the corrugations 39 may break or become compressed in the course of manufacture of the container 11, or possibly in the subsequent nesting or transporting or manual handling of the container after manufacture.

The particular orientation of the corrugations 19, in a direction so as to extend substantially circumferentially around the conically-shaped side wall portion 19, is also a critical feature of the present invention.

This generally circumferential orientation enables the outer insulating wrap 15 to be assembled with the inner container structure 13 in a way which maintains the corrugated configuration without breaking or compression during all subsequent shipping and handling of the container 11.

If the corrugations run vertically, the corrugations can be broken or crushed so that the wrap loses insulation qualities.

If the corrugations are too large or too stiff, the corrugations cannot be wrapped circumferentially about the side wall 19.

The microflute structure is therefore a critical feature of the invention.

The microflute structure may have corrugations per inch in the range of 10 to 11, the distance between adjacent ridges in the corrugations 39 should be approximately 0.1 inch, the height of each corrugation 39 from top to bottom should be about 0.030 inch to provide adequate insulation, and the corrugated laminate 31 of microflute corrugations 39 may be constructed of paper having a weight of about 25 pounds of paper per 3,000 square feet of laminate.

In a specific embodiment of the present invention, the number of flutes or corrugations 39 per inch is 10.6, the distance between flutes or corrugations 39 is substantially 0.1 inch, the height of each flute or corrugation is substantially 0.030 inch, and the corrugated laminate 31 is constructed of paper having a weight of 25 pounds of paper per 3,000 square feet of laminate.

In a specific embodiment of the present invention, the microflute laminate structure 31 is an F flute packaging industry structure.

Flutes larger than the F flute have been tried by applicant but the larger flutes have presented problems of breaking and compression of the corrugations.

The inner and outer sheet laminates 35 and 33 must also be thin enough and flexible enough to enable the wrap 15 to be assembled onto the side wall 19 without breaking or collapsing of the corrugations 39.

In specific embodiments of the present invention the inner and outer sheet laminates of thin flexible paper are constructed of paper having a weight of 25 pounds of paper per 3,000 square feet of laminate.

In a specific embodiment of the present invention the paper is fabricated from 50% post industrial waste and from 50% post consumer waste materials.

In the preferred embodiments of the present invention, the outer insulating wrap 15 is a smooth surface without any indents in the outer surface, other than slight indications of the underlying ridges of the generally circumferentially extending microflute corrugations, so that the outer insulating wrap means is not weakened by any such additional indents.

It is an important feature of the present invention that the outer insulating wrap 15 provides enough heat insulation to enable the container 11 to be held comfortably in the hand of a user when the container is filled with a liquid having temperatures up to or near the boiling point of water, but does not provide complete isolation or blocking of all such heat transfer.

Instead, the wrap 15 permits some heat to be transferred so as to provide a tactile sense of temperature in the hands of the user. This tactile feel signals the sensory system of the user that there is a hot liquid in the container. This in turn minimizes the possibility of unexpected burning of the lips, or other parts of the person of the user, which could result from an unexpectedly high temperature of the contents of the container when the contents of the container first engage the lips of the user.

This ability to provide tactile sensing of the fact that the liquid in the container 11 is very hot minimizes the risk of injury to the person drinking coffee or other hot liquid from the container 11.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. A disposable, insulated container comprising, an inner container structure having an upper end portion providing an open top, a lower end portion providing a closed bottom, and a generally conically extending side wall portion providing a closed side wall between the open top and the closed bottom, outer insulating wrap means extending both around and up and down the outer side of the side wall portion of the inner container structure for enabling the container to be held comfortably in the hand of a user when the container is filled with a liquid having temperatures up to or near the boiling point of water, adhering means adhering said outer insulating wrap means to the side wall portion of the inner container structure, said outer insulating wrap means comprising a microflute laminated structure having:

(a) a first corrugated laminate of microflute corrugations which are aligned so that the parallel extending ridges and depressions of the microflute corrugations are disposed substantially circumferentially around the side wall portion of the inner container structure, and (b) a second, outer sheet laminate of thin flexible paper extending on the outer side of the outer insulating wrap means and presenting a substantially smooth outer surface for engagement by the hand of a user of the container, and wherein the size of the microflute corrugations, the generally circumferentially extending orientation of the microflute corrugations, and the thin thickness of the outer paper sheet laminate enable the outer insulating wrap means to be wrapped and maintained in continuous, substantially uniform engagement with said side wall portion without breaking or collapsing of the corrugations.

2. The invention defined in claim 1 wherein the microflute corrugations transmit enough heat from said side wall portion and through the outer insulating wrap means so as to provide a tactile sense of temperature in the hands of the user to signal the user that there is hot liquid in the cup and to minimize the possibilities of unexpected burning of the lips or other parts of the person of a user which could result from an unexpected high temperature of the contents of the cup when the contents of the cup first engage the lips of the user.

3. The invention defined in claim 1 wherein the number of corrugations per inch in the first corrugated laminate are in the range of 10 to 11, the distance between adjacent ridges in the corrugations is approximately 0.1 inch, and the height of each corrugation from top to bottom is approximately 0.038 inch.

4. The invention defined in claim 3 wherein the microflute laminate structure is an F flute packaging industry structure.

5. The invention defined in claim 4 wherein the number of flutes per inch is 10.6, the distance between flutes is substantially 0.1 inch, the height of each flute is substantially 0.030 inch and wherein both the first corrugated laminate of microflute corrugations and the second, outer sheet laminate of thin flexible paper are constructed of paper having a weight of 25 pounds of paper per 3,000 square feet of laminate.

6. The invention defined in claim 1 wherein the outer insulating wrap means, prior to assembly on the inner container structure, are predisposed to wrap with an inwardly curved configuration.

7. The invention defined in claim 1 wherein the outer insulating wrap means comprise a structure which, prior to assembly on said side wall portion of the inner container structure, has a generally trapezoidal configuration and which is enough greater in circumference than said generally conically extending side wall portion so as to enable the end portions of the outer insulating wrap means to overlap in a band extending along the longitudinal axis of the inner container structure.

8. The invention defined in claim 7 wherein the inner container structure is a paper structure having a thin coating of polyethylene on the inside and on the outside of the inner container structure surfaces for blocking passage of fluid through the paper structure of said inner container structure and wherein said adhering means include a bonding of the outer insulating wrap means to said side wall portion of the inner container structure through the layer of polyethylene on the outer side wall portion of the inner container structure and wherein the adhering means also include an adhesive between the opposed facing surfaces of said overlap at the overlapping ends of the outer insulating wrap means and also an adhesive located at several spots on the inner surface of the outer wrap means and adhered to the areas of said side wall portion of the inner container structure which are engaged by said spots.

9. The invention defined in claim 8 wherein the adhesive is a cold vinyl adhesive which is 100% recyclable.

10. The invention defined in claim 8 wherein the adhesive is a hot melt adhesive which is 100% recyclable.

11. The invention defined in claim 1 wherein the outer insulating wrap means comprise a third, inner sheet laminate of thin flexible paper extending on the inner side of the outer insulating wrap means and presenting a substantially smooth inner surface for engagement with said side wall portion of the inner container structure.

12. The invention defined in claim 1 wherein the outer insulating wrap means is constructed of paper material which can be 100% recycled.

13. The invention defined in claim 12 wherein the paper is fabricated from 50% post industrial waste and 50% post consumer waste materials.

14. The invention defined in claim 1 wherein the outer surface of the second, outer sheet laminate of thin flexible paper is smooth enough and strong enough to accept Flexographic printing.

15. The invention defined in claim 1 wherein the outer surface of the outer insulating wrap means is a smooth surface without any indents in the outer surface, other than slight indications of the underlying ridges of the generally circumferentially extending microflute corrugations, so that the outer insulating wrap means is not weakened by any such additional indents.

16. A method of making a disposable, insulated container comprising, aligning an inner container structure in a position to receive an outer insulating wrap, said inner container structure having an upper end portion providing an open top, a lower end portion providing a closed bottom, and a generally conically extending side wall portion providing a closed side wall between the open top and the closed bottom forming an outer insulating wrap with dimensions and a configuration to enable the outer insulating wrap to be assembled onto said side wall portion of the inner container structure with the wrap extending both around and up and down the outer side wall of said side wall portion for enabling the container to be held comfortably in the hand of a user when the container is filled with a liquid having temperatures up to or near the boiling point of water, said outer insulating wrap comprising a microflute laminated structure having:

(a) a first corrugated laminate of microflute corrugations which are aligned so that the parallel extending ridges and depressions of the microflute corrugations are disposed substantially circumferentially around the side wall portion of the inner container structure, and (b) a second, outer sheet laminate of thin flexible paper extending on the outer side of the outer insulating wrap means and presenting a substantially smooth outer surface for engagement by the hand of a user of the container, and predisposing the outer insulating wrap to around said side wall portion prior to assembly of the outer insulating wrap on the inner container structure by forming the outer insulating wrap with an inwardly curved configuration prior to assembling the outer insulating wrap with the inner container structure applying an adhesive to certain spots on the inside surface of the outer insulating wrap, wrapping the outer insulating wrap into continuous, substantially uniform engagement with said side wall portion, adhering the outer insulating wrap to said side wall portion of the inner container structure, and wherein the size of the microflute corrugations, the generally circumferentially extending orientation of the microflute corrugations, and the thin thickness of the outer paper sheet laminate and the predisposing of the outer insulating wrap to wrap about said side wall portion enable the outer insulating wrap to be wrapped and maintained in continuous, substantially uniform engagement with said side wall portion without breaking or collapsing of the corrugations.

* * * * *